US007073704B2

(12) United States Patent
Moore

(10) Patent No.: US 7,073,704 B2
(45) Date of Patent: Jul. 11, 2006

(54) SECURE WINDOW MAILER AND METHOD OF MAKING

(75) Inventor: John A. Moore, Kettering, OH (US)

(73) Assignee: The Standard Register Company, Dayton, OH (US)

( * ) Notice: Subject to any disclaimer, the term of this patent is extended or adjusted under 35 U.S.C. 154(b) by 334 days.

(21) Appl. No.: 10/458,952

(22) Filed: Jun. 11, 2003

(65) Prior Publication Data

US 2004/0251299 A1 Dec. 16, 2004

(51) Int. Cl.
*B65D 27/00* (2006.01)

(52) U.S. Cl. ..... 229/92.3

(58) Field of Classification Search ..... 229/92.1–92.3, 229/71, 80, 304
See application file for complete search history.

(56) References Cited

U.S. PATENT DOCUMENTS 1,307,421 A * 6/1919 Schramm ..... 229/92.3
2,209,601 A * 7/1940 Heywood ..... 229/71
3,693,869 A * 9/1972 Eaves, Jr. ..... 229/302
3,837,565 A * 9/1974 Johnsen ..... 229/301
4,055,294 A * 10/1977 Traise ..... 229/69
4,413,984 A 11/1983 Alter
4,809,906 A * 3/1989 Lombardo ..... 229/304
4,927,072 A 5/1990 Jenkins et al.
4,981,251 A 1/1991 Jenkins et al.
5,154,344 A 10/1992 Loch
5,201,464 A 4/1993 File
5,207,592 A 5/1993 Loch
5,553,774 A 9/1996 Goodno
5,705,243 A * 1/1998 Mehta et al. ..... 428/40.1

* cited by examiner

*Primary Examiner*—Jes F. Pascua
(74) *Attorney, Agent, or Firm*—Dinsmore & Shohl LLP

(57) ABSTRACT

A business form or mailer intermediate, includes a substrate sheet having first and second surfaces, first and second parallel longitudinal edges and first and second opposite ends, and at least a first transverse fold line formed in the substrate perpendicular to the parallel longitudinal edges. The first fold line divides the substrate into two or more panels. An address area on one of the panels, and a window opening defined in another of the panels are in alignment when the substrate sheet is folded so that the address area may be viewed through the window opening. A pattern of adhesive is provided on the substrate, surrounding at least one of the address area and the window opening. Folding the substrate results in a seal around the window opening.

16 Claims, 4 Drawing Sheets

SECURE WINDOW MAILER AND METHOD OF MAKING

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

Various types of mailers with windows are in common use. Typically, the window consists of a die cut opening in a mailer panel which permits addressee information inside the mailer to be read. The opening may be covered with a transparent patch, secured in placeover the cut out opening by means of an adhesive. The transparent patch may consist of any suitable film of transparent material such as glassine, cellophane, or polymeric materials. The adhesive is generally applied to the mailer substrate around the perimeter of the die cut opening to join the outer perimeter of the transparent patch to the substrate. The transparent patch can be adhesively secured to either the inside surface or the outside surface of the mailer substrate. The transparent patch insures that the contents of the mailer remain in the mailer.

In some modern mailing systems, a mailer is formed from a single sheet after it has been imaged by a nonimpact printer. The sheets are stacked in an input tray and fed individually as single plies through the printer, after which the sheets are each folded to form a mailer. The name and address of the addressee are printed on an interior panel of the mailer, but are viewed through the window after the mailer has been folded.

One difficulty encountered in using mailers that have transparent window patches is that the added thickness of the sheets caused by such window patches over the die-cut window openings causes uneven stacks in the input and output trays. Additionally, transparent patches covering die-cut window openings may also snag on equipment or on other mailers as the mailers are fed and folded, resulting in mis-feeding and jamming of equipment. This usually results in the destruction of one or more mailers and requires that the machinery be stopped so that the destroyed mailers can be removed. Further, since such mailers are individually created and addressed, it is necessary to determine the addressee of each destroyed mailer, so that substitute mailers can be printed.

Other mailers include windows that are formed by the application of transparentizing coating material to a portion of a mailer panel. Such a mailer is disclosed in U.S. Pat. No. 5,418,205, issued May 23, 1995, to Mehta et al., and assigned to the assignee of the present application. While a mailer with a transparentized portion forming the mailer window avoids problems associated with window patches, such a mailer may not be totally transparent, but may require that the transparentized window be in close proximity to the address information for optimum readability.

Other mailers use an uncovered window, simply defined by a die cut opening. While this results in a mailer in which sheet feeding is improved and addresses are easily read, it also produces a mailer envelope which is not completely sealed. Such an envelope may permit additional information, inside the mailer to the side of the address information, to be read. In fact, window mailers having transparent patches are also subject to undesirable viewing of the mailer contents by moving the window away from the address panel to permit other printed information with the mailer to be seen.

It is seen that there is a need for a mailer construction having a window arrangement that does not hinder printing and folding operations. Further, there is a need for a mailer in which the security of the mailer contents is enhanced.

SUMMARY OF THE INVENTION

These needs are met by a business form or mailer intermediate according to the present invention that includes a substrate sheet having first and second surfaces, first and second parallel longitudinal edges and first and second opposite ends. At least a first transverse fold line is formed in the substrate perpendicular to the parallel longitudinal edges. The first fold line divides the substrate into at least first and second panels. An address area is provided on the first surface of one of the first and second panels, and a window opening is defined in the other of the first and second panels. The address area and the window opening are positioned on the panels in alignment such that when the substrate sheet is folded along the first transverse line and the first surface of the first panel is brought into contact with the first surface of the second panel, the address area may be viewed through the window opening. A pattern of adhesive is positioned on the first surface of the substrate, surrounding at least one of the address area and the window opening, whereby folding the substrate at the first transverse line and bringing the first surface of the first panel into contact with the first surface of the second panel results in a seal around the window opening between the first and second panels.

The adhesive may be any known adhesive, such as a thermally activated adhesive, or a pressure sensitive adhesive. Alternatively, the adhesive may be a pressure sensitive cohesive. The pattern of cohesive on the first surface of the substrate surrounds both the address area and the window opening, whereby folding the substrate at the first transverse line and bringing the first surface of the first panel into contact with the first surface of the second panel results in contact between the cohesive surrounding the address area and the cohesive surrounding the window opening. The pattern of cohesive on one of the first and second panels may be larger than the pattern of cohesive on the other of the first and second panels, whereby the area of contact between the adhesive patterns is substantially that of the smaller of the adhesive patterns, allowing for registration between the two adhesive patterns.

A second transverse fold line may be formed in the substrate perpendicular to the parallel longitudinal edges, the second fold line dividing the substrate into second and third panels. The business form or mailer intermediate may be a Z-fold business form or mailer intermediate or, alternatively, a C-fold business form or mailer intermediate.

The window opening may be a die cut window opening in the other of the first and second panels. A patch of transparent material may cover the die cut window opening. Alternatively, the window opening may be defined by a transparentized area of the other of the first and second panels.

Another embodiment of the business form or mailer intermediate includes a substrate sheet having first and second surfaces, first and second parallel longitudinal edges and first and second opposite ends. First and second transverse fold lines are formed in the substrate sheet and define first, second, and third panels in the substrate sheet. Each of the fold lines is perpendicular to the parallel longitudinal edges. The first fold line is positioned between the first and second panels, and the second fold line is positioned between the second and third panels. An address area is provided on the first surface of the first panel, and a window opening is defined in the third panel. The address area and the window opening are positioned on the panels in alignment such that when the substrate sheet is folded along the first and second transverse lines and the first surface of the first panel is brought into contact with the second surface of the third panel, the address area may be viewed through the window opening. A pattern of adhesive is provided on the substrate sheet, surrounding at least one of the address area and the window opening. Folding the substrate sheet along the first and second transverse lines such that the first surface of the first panel is brought into contact with the second surface of the third panel results in a seal around the window opening between the first and third panels.

Accordingly, it is an object of the present invention to provide a business form or mailer intermediate in which an adhesive surrounds the window defined in one of the business form or mailer panels; to provide such a business form or mailer intermediate in which access to the interior of the mailer is restricted; and to provide such a business form or mailer intermediate in which processing of the business form or mailer intermediate is facilitated.

Other objects and advantages of the invention will be apparent from the following detailed description, the accompanying drawings, and the appended claims.

DETAILED DESCRIPTION OF THE PREFERRED EMBODIMENTS

Figure 1:
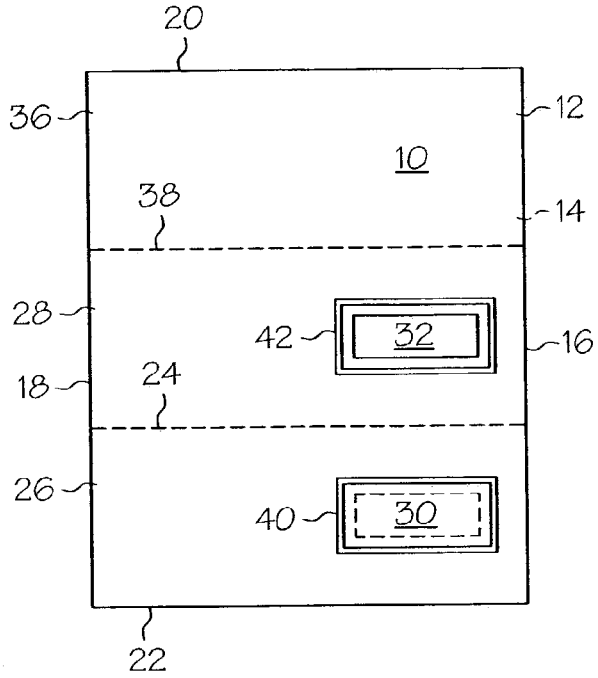
FIG. 1 is a plan view of a first embodiment of the business form or mailer intermediate configured according to the present invention.
Figure 2:
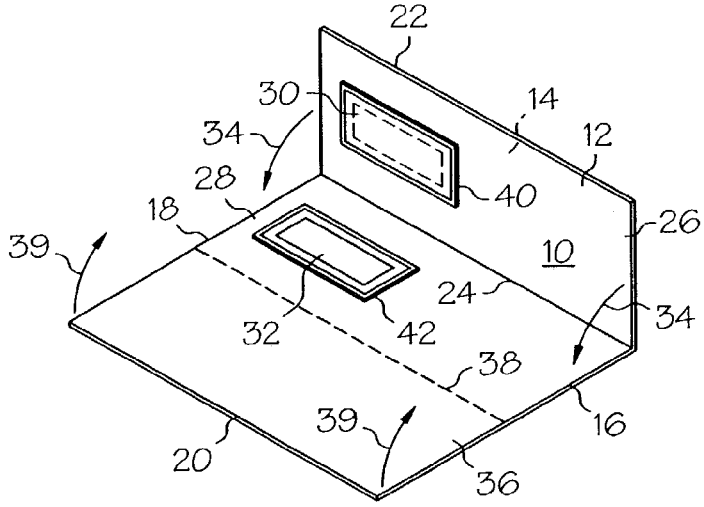
FIG. 2 is a perspective view, showing the mailer form of FIG. 1 being folded.
Figure 3:
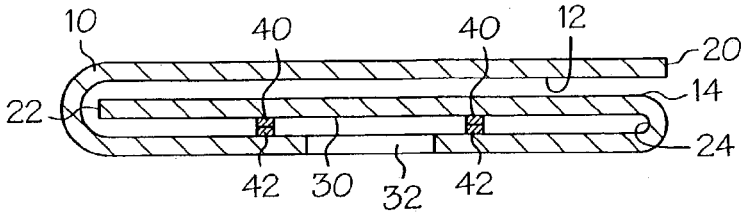
FIG. 3 is a sectional view taken through the address area and window of the mailer after the mailer is folded.

Reference is made to FIGS. 1–3 which show a business form or mailer intermediate constructed according to a first embodiment of the present invention. The mailer intermediate includes a substrate sheet 10, preferably made of paper, having first and second surfaces 12 and 14, respectively. The substrate sheet 10 has first and second parallel longitudinal edges 16 and 18, and first and second opposite ends 20 and 22. At least a first transverse fold line 24 is formed in the substrate 10, perpendicular to the parallel longitudinal edges 16 and 18. The first fold line 24 divides the substrate 10 into at least first and second panels 26 and 28.

An address area 30, indicated by a broken line in FIGS. 1 and 2, is provided on the first surface 12 of one of the first and second panels 26 and 28. A window opening 32 is defined in the other of the first and second panels 26 and 28. It will be noted that the address area 30 and the window opening 32 are positioned on the panels 26 and 28 in alignment such that when the substrate sheet 10 is folded along the first transverse line 24, as illustrated by the arrows 34 in FIG. 2, and the first surface 12 of the first panel 26 is brought into contact with the first surface 12 of the second panel 28, the address area 30 may be viewed through the window opening 32. Shown in FIGS. 1–3 is a mailer having a third panel 36 defined by a second transverse fold line 38 formed in the substrate 10, perpendicular to the parallel longitudinal edges 16 and 18. The second fold line divides the substrate 10 into the second and third panels 28 and 36. As may be seen in FIG. 3, the mailer is a C-fold configuration, in which the third panel 36 is folded over the second surface 14 of the first panel 26, as indicated by arrows 39 in FIG. 2. The mailer will be held in the C-fold configuration by appropriate adhesive (not shown) which may typically be positioned along peripheral edges of the substrate 10. The mailer may then be opened by the removal of marginal portions in known fashion, assisted by peripheral or marginal perforation lines, omitted here for purposes of clarity.

A pattern of adhesive is provided on the first surface 12 of the substrate 10, surrounding at least one of the address area 30 and the window opening 32. In the embodiment of FIGS. 1–3, the adhesive is a pressure sensitive cohesive, and the pattern of adhesive on the first surface 12 of the substrate 10 surrounds both the address area 30 and the window opening 32, as indicated at 40 and 42. Folding the substrate 10 at the first transverse line 24 and bringing the first surface of the first panel 26 into contact with the first surface of the second panel 28 results in a seal around the window opening 32 between the first and second panels 26 and 28. When the panels are folded in this fashion, there is sealing contact between the cohesive 40 surrounding the address area 30 and the cohesive 42 surrounding the window opening 32, as shown in FIG. 3. The scaling along the periphery of the window insures that panels 26 and 28 cannot be moved apart by someone wishing to view the interior of the mailer. Further, in the event that the window 32 is a transparentized portion of the mailer, sealing the periphery of the window insures that the address information can be easily read.

It will be appreciated that opening a C-folded mailer shown in FIGS. 1–3 will require separating the bond between cohesive 40 and cohesive 42. It is important that this be accomplished without tearing the mailer panels. This requires that the bond between the cohesive patterns be less than the bond between the cohesive and the substrate sheet 10. To control this bond strength, it is necessary that the area of the surface contact between the cohesive 40 and the cohesive 42 be controlled. If the lines of cohesive in the two patterns are relatively narrow in order to produce a low level of bond, any misalignment between the two patterns will result in a reduction in the overlapping surface area between the two cohesives, producing less than the desired bond strength. This may be avoided, however, by using a pattern of cohesive on one of the first and second panels 26 and 28 that is larger than the pattern of adhesive on the other of the panels. Since there is bonding only where there is overlap between the surfaces of adhesive patterns 40 and 42, and since the area of contact between the adhesive patterns of differing size is substantially that of the smaller of the adhesive patterns, this arrangement allows for some leeway in the registration of the two adhesive patterns, while maintaining consistent bond strength.

As an alternative construction, a pressure sensitive adhesive of the type that will adhere directly to the substrate 10 may be used. In such an arrangement, a pattern of pressure sensitive adhesive is provided around only one of address area 30 and window opening 32. Since only one adhesive pattern is utilized, the problem of registration encountered with cohesive patterns does not occur. Other types of adhesive materials may also be used around the address area 30 or window opening 32, including for example thermally activated adhesive or remoist adhesive. In each case, the adhesive arrangement is configured to permit separation of the panels when the mailer is opened without substantially tearing the substrate sheet 10.

As shown in FIGS. 1–3, the window opening 32 may be a simple die cut window opening. Alternatively, however, a patch of transparent material (not shown) may be included, attached to cover the die cut window opening. Further, alternatively, the window opening may be defined by a transparentized area of the panel 28. In any of these variations, the adhesive attachment of the panel carrying the address information and the panel in which the window is defined will result in added security since the panels will not be separable to permit viewing printing on interior surfaces of the mailer panels. Further, if the window 32 is a simple die cut window opening, the adhesive attachment around the opening produces a completely closed mailer. Finally, if the window 32 is a transparentized area, the adhesive attachment will keep the surface carrying the address close to the transparentized material, making the address more legible.

Figure 4:
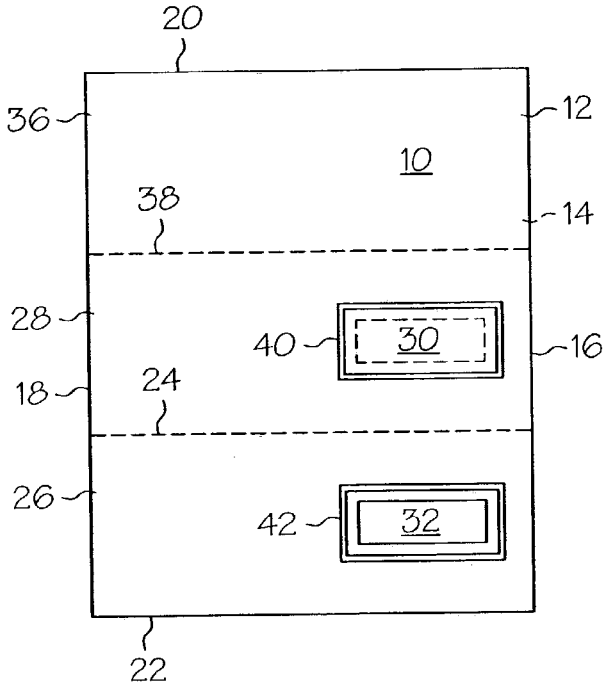
FIG. 4 is a plan view of a second embodiment of the business form or mailer intermediate configured according to the present invention.
Figure 5:
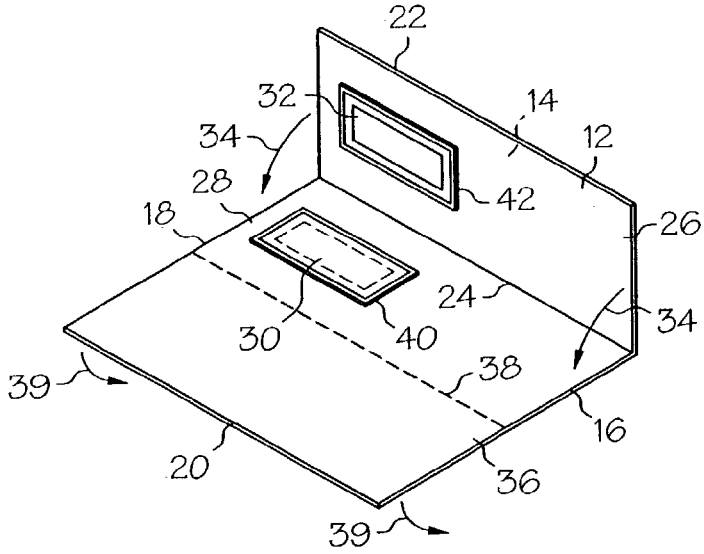
FIG. 5 is a perspective view, showing the mailer form of FIG. 4 being folded.
Figure 6:
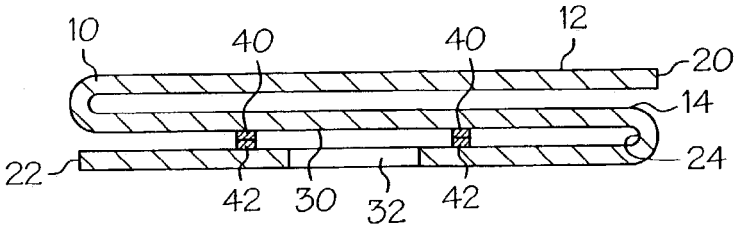
FIG. 6 is a sectional view taken through the address area and window of the mailer after the mailer is folded.

FIGS. 4–6 illustrate a second embodiment of the business form or mailer intermediate of the present invention. This embodiment is similar in certain respects to that of FIGS. 1–3 and for this reason the same reference numerals have been used in FIGS. 4–6 to indicate corresponding structure. In this embodiment, as with the first embodiment, the mailer intermediate includes a substrate sheet 10, preferably made of paper, having first and second surfaces 12 and 14, respectively. The substrate sheet 10 has first and second parallel longitudinal edges 16 and 18, and first and second opposite ends 20 and 22. At least a first transverse fold line 24 is formed in the substrate 10, perpendicular to the parallel longitudinal edges 16 and 18. The first fold line 24 divides the substrate 10 into at least first and second panels 26 and 28.

In this embodiment, address area 30 is provided on the first surface 12 of the second panel 28. A window opening 32 is defined in the first panel 26. The address area 30 and the window opening 32 are positioned on the panels 28 and 26, respectively, in alignment such that when the substrate sheet 10 is folded along the first transverse line 24, as indicated by the arrows 34 in FIG. 5, and the first surface 12 of the first panel 26 is brought into contact with the first surface 12 of the second panel 28, the address area 30 can be seen through the window opening 32.

The mailer has a third panel 36 defined by a second transverse fold line 38 formed in the substrate 10, perpendicular to the parallel longitudinal edges 16 and 18. The second fold line divides the substrate 10 into the second and third panels 28 and 36. As may be seen in FIG. 6, the mailer is intended to be folded into a Z-fold configuration. The third panel 36 is folded under the second panel 28, as indicated by arrows 39 in FIG. 5. The mailer will be held in the Z-fold configuration and effectively sealed by appropriate adhesive (not shown) which may typically be positioned along peripheral edges of the substrate 10. When the mailer is received by the addressee, it can be opened by the removal of marginal portions in known fashion, assisted by peripheral or marginal perforation lines, omitted here for purposes of clarity.

As with the first embodiment, a pattern of adhesive is provided on the first surface 12 of the substrate 10, surrounding at least one of the address area 30 and the window opening 32. Illustrated in FIGS. 4–6 is a pressure sensitive cohesive, surrounding both the address area 30 and the window opening 32, as indicated at 40 and 42. When the panels are folded, as shown in FIG. 6, there is sealing contact between the cohesive 40 surrounding the address area 30 and the cohesive 42 surrounding the window opening 32. Cohesive patterns 40 and 42 may differ in dimensions to provide for slight mispositioning of the patterns. It will be appreciated that a pressure sensitive adhesive, a thermally activated adhesive, or another known adhesive may be substituted for the cohesive 40 and 42. With such adhesives, a pattern of adhesive may be provided around only one of address area 30 and window opening 32. Since only one adhesive pattern is utilized, the problem of registration encountered with cohesive patterns does not occur. In any event, it is preferable that the sealing between panels by cohesive 40 and 42 be quite light so that the panels can be separated without damaging the substrate sheet 10.

The window opening 32 may be a simple die cut window opening, or a patch of transparent material (not shown) may be included, attached to cover the die cut window opening. Alternatively, the window opening may be defined by a transparentized area of the panel 26.

Figure 7:
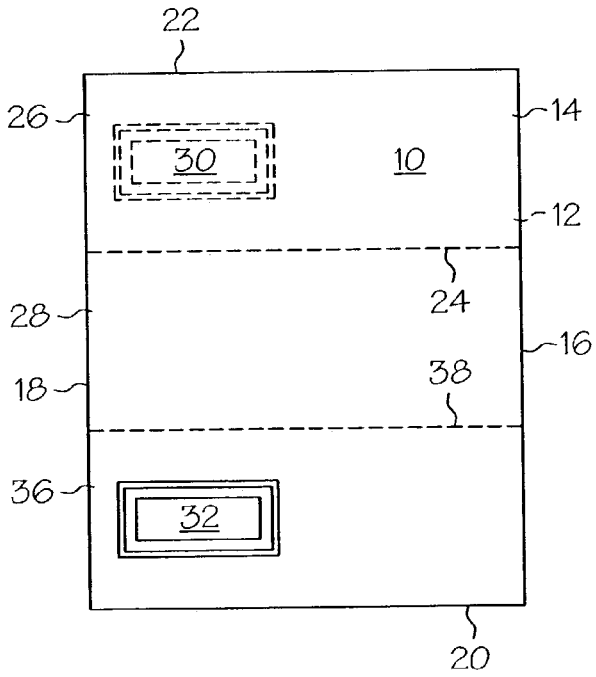
FIG. 7 is a plan view of a first embodiment of the business form or mailer intermediate configured according to the present invention.
Figure 8:
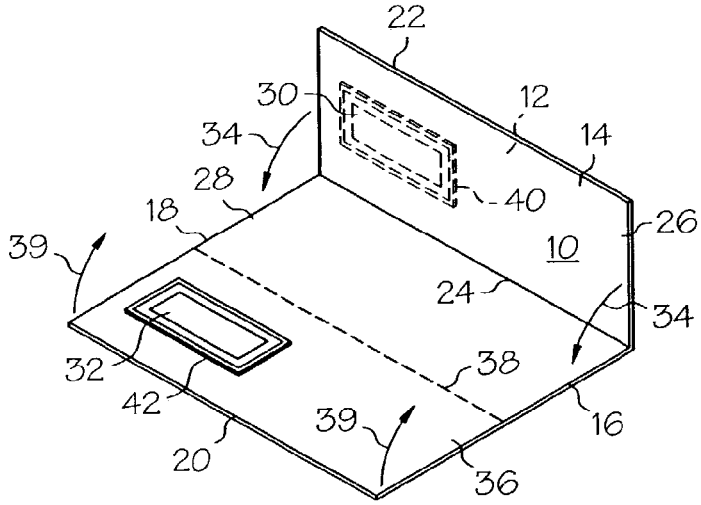
FIG. 8 is a perspective view, showing the mailer form of FIG. 7 being folded.
Figure 9:
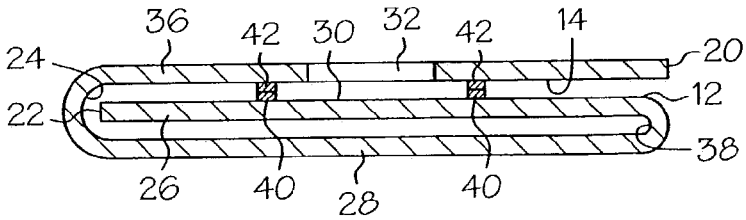
FIG. 9 is a sectional view taken through the address area and window of the mailer after the mailer is folded.

FIGS. 7–9 illustrate a third embodiment of the business form or mailer intermediate of the present invention. This embodiment is similar in some respects to the first and second embodiments, described above, and for this reason the same reference numerals have been used in FIGS. 7–9 to indicate corresponding structure. In this embodiment, as with the prior embodiments, the mailer intermediate includes a substrate sheet 10, preferably made of paper, having first and second surfaces 12 and 14, respectively. The substrate sheet 10 has first and second parallel longitudinal edges 16 and 18, and first and second opposite ends 20 and 22. First and second transverse fold lines 24 and 38 are formed in the substrate 10, perpendicular to the parallel longitudinal edges 16 and 18. The first and second transverse fold lines 24 and 38 define first, second, and third panels 26, 28, and 36, respectively. The first fold line 24 is positioned between first and second panels 26 and 28, and the second fold line 38 is positioned between second and third panels 28 and 36.

In this embodiment, address area 30 is provided on the first surface 12 of one of the first panel 26. The substrate sheet 10 in FIGS. 7 and 8 is oriented with first surface 12 facing away from the observer. A window opening 32 is defined in the third panel 36. The address area 30 and the window opening 32 are positioned on the panels 26 and 36, respectively, in alignment such that when the substrate sheet 10 is folded along the first transverse line 24 and along the second transverse line 38, as illustrated by the arrows 34 and 39 in FIG. 8, and the first surface 12 of the first panel 26 is brought into contact with the second surface 14 of the third panel 36, the address area 30 can be viewed through the window opening 32.

As may be seen in FIG. 9, the mailer is folded into a C-fold configuration, in which the first panel 26 is folded under the third panel 36. As with the previously described embodiments, the mailer will be held in the C-fold configuration by appropriate adhesive (not shown) which may typically be positioned along peripheral edges of the substrate 10. The mailer may then be opened by the removal of marginal portions in known fashion, assisted by peripheral or marginal perforation lines, omitted here for purposes of clarity.

As with the prior embodiments, a pattern of adhesive is provided on the substrate 10, surrounding at least one of the address area 30 and the window opening 32. Illustrated in FIGS. 7–9 is a pressure sensitive cohesive, surrounding both the address area 30 and the window opening 32, as indicated at 40 and 42. When the panels are folded, as shown in FIG. 9, there is sealing contact between the cohesive 40 surrounding the address area 30 and the cohesive 42 surrounding the window opening 32. It will be appreciated that a pressure sensitive adhesive, thermally activated adhesive, or other known adhesive may be substituted for the cohesive 40 and 42. In such an arrangement, a pattern of adhesive may be provided around only one of address area 30 and window opening 32. Since only one adhesive pattern is utilized, the problem of registration encountered with cohesive patterns does not occur. In any event, the sealing provided around openings 32 is kept light to facilitate opening the mailer without damaging the substrate 10.

As with the previous embodiments, the window opening 32 may be a simple die cut window opening, or a patch of transparent material (not shown) may be included, attached to cover the die cut window opening. Alternatively, the window opening may be defined by a transparentized area of the panel 26.

Figure 10:
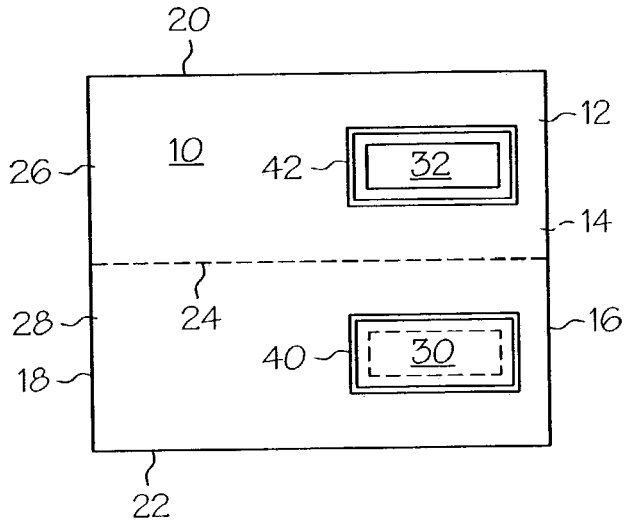
FIG. 10 is a plan view of a first embodiment of the business form or mailer intermediate configured according to the present invention.
Figure 11:
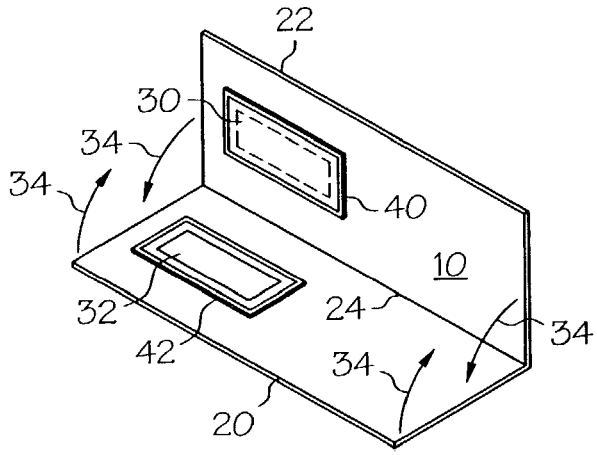
FIG. 11 is a perspective view, showing the mailer form of FIG. 10 being folded.
Figure 12:
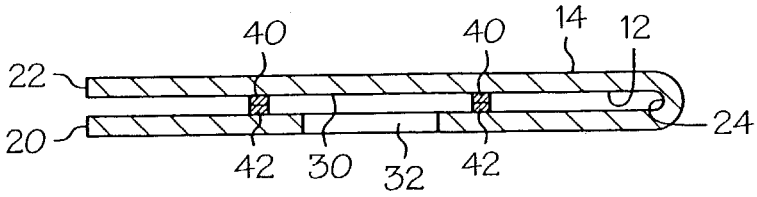
FIG. 12 is a sectional view taken through the address area and window of the mailer after the mailer is folded.

FIGS. 10–12 illustrate a fourth embodiment of the business form or mailer intermediate of the present invention. This embodiment is similar to that of FIGS. 1–3 in some respects and for this reason the same reference numerals have been used in FIGS. 10–12 to indicate corresponding structure. In this embodiment, as with the first embodiment, the mailer intermediate includes a substrate sheet 10, preferably made of paper, having first and second surfaces 12 and 14, respectively. The substrate sheet 10 has first and second parallel longitudinal edges 16 and 18, and first and second opposite ends 20 and 22. A first transverse fold line 24 is formed in the substrate 10, perpendicular to the parallel longitudinal edges 16 and 18. The first fold line 24 divides the substrate 10 into first and second panels 26 and 28.

Address area 30 is provided on the first surface 12 of the second panel 28. A window opening 32 is defined in the first panel 26. The address area 30 and the window opening 32 are positioned on the panels 28 and 26, respectively, in alignment such that when the substrate sheet 10 is folded along the first transverse line 24, as illustrated by the arrows 34 in FIG. 11, and the first surface 12 of the first panel 26 is brought into contact with the first surface 12 of the second panel 28, the address area 30 may be viewed through the window opening 32.

As may be seen in FIG. 12, the mailer is folded in a V-fold configuration. The mailer will be held in the V-fold configuration by appropriate adhesive (not shown) which may typically be positioned along peripheral edges of the substrate 10. The mailer may then be opened by the removal of marginal portions in known fashion, assisted by peripheral or marginal perforation lines, omitted here for purposes of clarity.

As with the other embodiments, a pattern of adhesive is provided on the first surface 12 of the substrate 10, surrounding at least one of the address area 30 and the window opening 32. Illustrated in FIGS. 10–12 is a pressure sensitive cohesive, surrounding both the address area 30 and the window opening 32, as indicated at 40 and 42. When the panels are folded, as shown in FIG. 11, there is sealing contact between the cohesive 40 surrounding the address area 30 and the cohesive 42 surrounding the window opening 32. It will be appreciated that a pressure sensitive adhesive, thermally activated adhesive, or other known adhesive may be substituted for the cohesive 40 and 42. The window opening 32 may be a simple die cut window opening, or a patch of transparent material (not shown) may be included, attached to cover the die cut window opening. Alternatively, the window opening may be defined by a transparentized area of the panel 26. With any of the embodiments discussed above in which the window 32 is a patch of transparent material covering a die cut opening, or a transparentized area of a substrate panel, the address information may either be printed in the address area 30 or, alternatively, printed in mirror image on the inside surface of the transparent patch or the transparentized area. In those instances where the address information is printed in mirror image, the address area 30 is an appropriate color, such as white, yellow, or the like, to contrast with the mirror image address information, enhancing the visibility of the address information. It will be understood that the phrase "address area" is intended to include both an area which has been printed with address information, and an area which has not been printed with address information but which serves as a background for address information printed in mirror image on a transparent window or transparentized area.

It will be seen that all of the embodiments provide for secure closure of the envelope, enhancing security. Having described the invention in detail and by reference to preferred embodiments thereof, it will be apparent that modifications and variations are possible without departing from the scope of the invention defined in the appended claims.

What is claimed is:

1. A business form or mailer intermediate, comprising: a substrate sheet having first and second surfaces, first and second parallel longitudinal edges and first and second opposite ends; at least a first transverse fold line formed in said substrate perpendicular to said parallel longitudinal edges, said first fold line dividing said substrate into at least first and second panels;

an address area on said first surface of one of said first and second panels, and a window opening defined in the other of said first and second panels, said address area and said window opening being positioned on said panels in alignment such that when said substrate sheet is folded along said first transverse line and said first surface of said first panel is brought into contact with said first surface of said second panel, said address area may be viewed through said window opening; and a pattern of adhesive on said first surface of said substrate, surrounding and substantially adjacent to at least one of said address area and said window opening, whereby folding said substrate at said first transverse line and bringing said first surface of said first panel into contact with said first surface of said second panel results in a seal around said window opening between said first and second panels, said adhesive being a pressure sensitive cohesive and said pattern of adhesive on said first surface of said substrate surrounding both said address area and said window opening, whereby folding said substrate at said first transverse line and bringing said first surface of said first panel into contact with said first surface of said second panel results in contact between the cohesive surrounding said address area and the cohesive surrounding said window opening, the bond between said cohesive on said first and second panels being less than the bond between said cohesive and said panels.

2. The business form or mailer intermediate of claim 1 in which said adhesive is a pressure sensitive adhesive.

3. The business form or mailer intermediate of claim 1 in which said pattern of adhesive on one of said first and second panels is larger than said pattern of adhesive on the other of said first and second panels, whereby the area of contact between the adhesive patterns is substantially that of the smaller of the adhesive patterns, allowing for registration between the two adhesive patterns.

4. The business form or mailer intermediate of claim 1 further comprising a second transverse fold line formed in said substrate perpendicular to said parallel longitudinal edges, said second fold line dividing said substrate into second and third panels.

5. The business form or mailer intermediate of claim 4 in which said business form or mailer intermediate is a Z-fold business form or mailer intermediate.

6. The business form or mailer intermediate of claim 4 in which said business form or mailer intermediate is a C-fold business form or mailer intermediate.

7. The business form or mailer intermediate of claim 1 in which said window opening is a die cut window opening in said other of said first and second panels.

8. The business form or mailer intermediate of claim 7 further comprising a patch of transparent material covering said die cut window opening.

9. The business form or mailer intermediate of claim 1 in which said window opening is defined by a transparentized area of said other of said first and second panels.

10. A business form or mailer intermediate, comprising: a substrate sheet having first and second surfaces, first and second parallel longitudinal edges and first and second opposite ends; first and second transverse fold lines formed in said substrate sheet and defining first, second, and third panels in said substrate sheet, each of said fold lines being perpendicular to said parallel longitudinal edges, said first fold line positioned between first and second panels, and said second fold line positioned between second and third panels;

an address area on said first surface of said first panel, and a window opening defined in said third panel, said address area and said window opening being positioned on said panels in alignment such that when said substrate sheet is folded along said first and second transverse lines and said first surface of said first panel is brought into contact with said second surface of said third panel, said address area may be viewed through said window opening; and a pattern of adhesive on said substrate sheet, surrounding and substantially adjacent to at least one of said address area and said window opening, whereby folding said substrate sheet along said first and second transverse lines such that said first surface of said first panel is brought into contact with said second surface of said third panel results in a seal around said window opening between said first and third panels.

11. The business form or mailer intermediate of claim 10 in which said adhesive is a pressure sensitive adhesive.

12. The business form or mailer intermediate of claim 10 in which said adhesive is a pressure sensitive cohesive and in which said pattern of adhesive surrounds both said address area and said window opening, whereby folding said substrate at said first and second transverse lines and bringing said first surface of said first panel into contact with said second surface of said third panel results in contact between the cohesive surrounding said address area and the cohesive surrounding said window opening.

13. The business form or mailer intermediate of claim 12 in which said pattern of adhesive on one of said first and third panels is larger than said pattern of adhesive on the other of said first and third panels, whereby the area of contact between the adhesive patterns is substantially that of the smaller of the adhesive patterns, allowing for variation in registration between the two adhesive patterns.

14. The business form or mailer intermediate of claim 10 in which said window opening is a die cut window opening.

15. The business form or mailer intermediate of claim 14 further comprising a patch of transparent material covering said die cut window opening.

16. The business form or mailer intermediate of claim 10 in which said window opening is defined by a transparentized area of said other of said first and second panels.

* * * * *